US006357679B1

(12) United States Patent
Radke

(10) Patent No.: US 6,357,679 B1
(45) Date of Patent: Mar. 19, 2002

(54) MEDICATION CRUSHER AND METHOD OF USING SAME

(76) Inventor: George F. Radke, 4974 Dogwood Dr., Tsawwassen, Delta, British Columbia (CA), V4M 1M6

( * ) Notice: Subject to any disclaimer, the term of this patent is extended or adjusted under 35 U.S.C. 154(b) by 0 days.

(21) Appl. No.: 09/556,714

(22) Filed: Apr. 21, 2000

(51) Int. Cl.[7] ..... B02C 19/08

(52) U.S. Cl. ..... 241/30; 241/169.1; 241/169.2; 241/DIG. 27

(58) Field of Search ..... 241/30, 169.2, 241/169.1, DIG. 27

(56) References Cited

U.S. PATENT DOCUMENTS 3,915,393 A 10/1975 Elkins
5,067,666 A * 11/1991 Sussman ..... 241/DIG. 27

FOREIGN PATENT DOCUMENTS

CA 2057245 6/1993

* cited by examiner

*Primary Examiner*—Mark Rosenbaum
(74) *Attorney, Agent, or Firm*—John Russell Uren

(57) ABSTRACT

Apparatus and method for crushing medication. A crushing member mounted within a housing is rotatable about two axes. Rotation about the first axis allows relative movement between the crushing member and an anvil thereby to allow the medication to be crushed. Rotation of the crushing member about the second axis allows access to the medication and removal of the medication which may be within a receptacle. The receptacle and the crushing member have a complementary frustoconical configuration allowing the receptacle to be positioned on the crushing member with the medication between the crushing member and the receptacle. A second receptacle may be used with a similar configuration, the second receptacle being mounted over the first receptacle with the medication therebetween to prevent contamination and spillage.

18 Claims, 2 Drawing Sheets

MEDICATION CRUSHER AND METHOD OF USING SAME

This invention relates to a medication crusher and, more particularly, to a medication crusher used to pulverize or crush pills for a user using rotational movement.

BACKGROUND OF THE INVENTION

Many individuals taking medication are simply unable to swallow pills and, further, many other individuals cannot swallow pills relatively large in size although they may be able to swallow smaller pills. In certain cases, it may be desirable to provide for medication in a non-obvious form when sedation is necessary for example. The effects of not taking medication because of its pill form can, of course, adversely effect the health of such people and prolong sickness and other uncomfortable symptoms.

Pill or medicine crushers are known. Such a medication crushing apparatus is shown in U.S. Pat. No. 3,915,393 (Elkins). Elkins places a paper cup open end up on an anvil with the medication positioned in the cup. A further paper cup of identical size is placed on the first paper cup. A crushing plate is attached to a handle which reciprocates in a circular arc. The crushing plate enters the further cup and exerts a downward force on the lowermost area of the cup which then crushes the medication. Following the crushing action, the top paper cup is removed from the crushing plate and the medication is subsequently processed for ingestion.

The apparatus works in a relatively satisfactory manner but the force applied to the handle must sometimes be substantial, particularly for larger pills. Further, in order for the lever to which the crushing plate is attached to apply the necessary crushing force, the lever has a relatively long length making the medicine crusher of the '393 patent unnecessarily large. A further disadvantage of the apparatus of the '393 patent is that the force of the crushing action is generally centered somewhat off the middle of the medication. The medication may be crushed relatively unevenly and some areas may not be crushed at all. Yet a further problem is that the noise level associated with crushing medication using the technique disclosed by aforementioned Elkins is high.

A further medication crusher is illustrated and described in Canadian Patent 5,060,862 (Allair). The '862 patent teaches a medication holder which is positioned in a plastic receptacle. The receptacle is placed on the base of the apparatus. A crusher member attached to a shaft is allowed to "fall" on the pill in an attempt to initially crush at least portions of the pill. Thereafter, the crusher member is rotated downwardly onto the pill which serves to further pulverize the pill pieces.

There are, however, numerous disadvantages inherent in this machine. First, since there is no protection between the crusher member and the medication, subsequent use of the apparatus, unless cleaned, has the opportunity to contaminate the subsequent medication. Second, there is an initial noise level which may be objectionable particularly when used for prolonged periods of time. Third, the device is relatively complex to use thereby taking unnecessary time and being prone to breakdown.

SUMMARY OF THE INVENTION

According to one aspect of the invention, there is provided apparatus for crushing medication comprising an anvil, a crusher member separated from said anvil, said crusher member and said anvil having relative rotational movement about a first rotational axis extending perpendicular to said anvil to allow said anvil and said crusher member to decrease the distance therebetween to crush said medication and to allow the distance between said anvil and said crusher member to increase thereby to reduce and terminate force between said crusher member and said anvil, one of said crusher member and said anvil being rotatable about a second rotational axis perpendicular to said first rotational axis to allow release of said medication from one of said anvil or crusher member.

According to a further aspect of the invention, there is provided a method of crushing medication comprising the steps of positioning said medication between an anvil and a crusher member, rotating one of said anvil or crusher member in a first direction to cause relative rotational movement about a first axis between said anvil and said crusher member and to decrease the distance between said anvil and said crusher member and crush said medication, rotating one of said anvil or base in a direction opposite to said first direction to increase the distance between said anvil and said crusher member and rotating one of said anvil or crusher member about a second axis perpendicular to said first axis to allow access and removal of said crushed medication.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
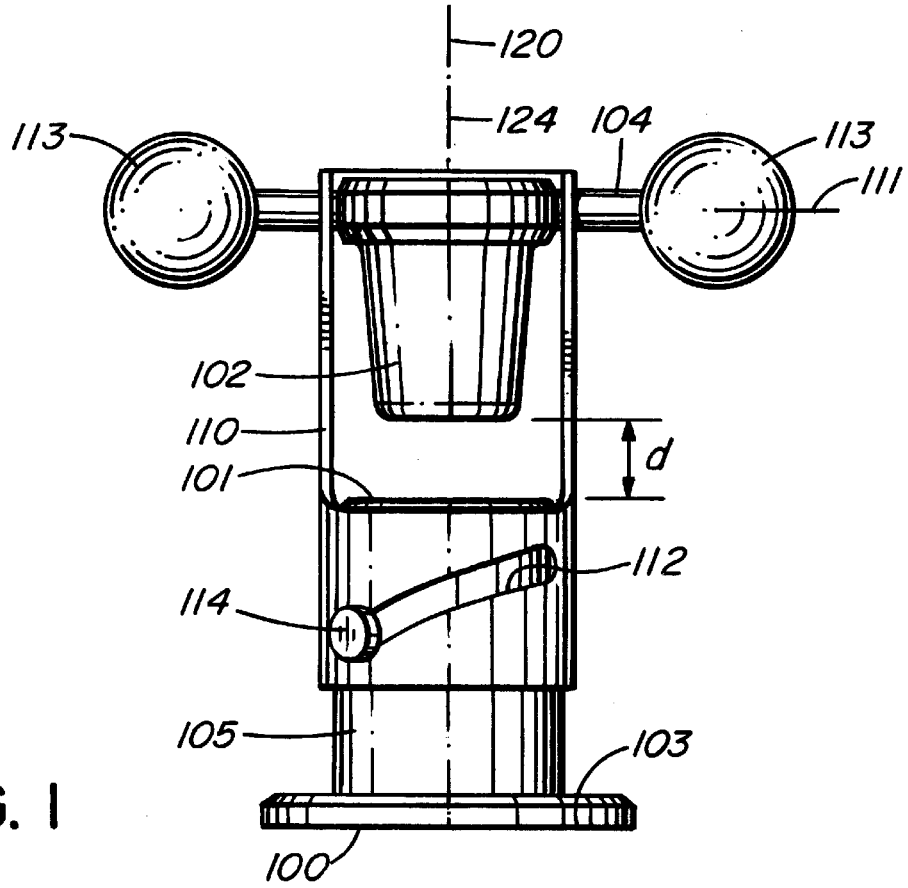
FIG. 1 is a side diagrammatic view of the medication crusher according to the invention in a first configuration wherein the anvil is located at its furthermost distance from the crusher member.

Referring now to the drawings, a medication crusher is illustrated generally at 100 in FIG. 1. The medication crusher 100 has an anvil 101 mounted on a base 105 which is attached to a support 103 which is conveniently flat so that the medication crusher 100 may be placed on any flat surface during operation.

Crusher member 102 is mounted to a shaft 104 which, in turn, is mounted for rotational movement about a first rotational axis 111 in a housing 110. Shaft 104 has handles 113, conveniently spherical in configuration, for ease of operation and comfort. Housing 110 has a cammed surface 112 which mates with a follower 114 connected to the base 105 which follower 114 allows rotational movement of housing 110 about rotational axis 120 thereby to allow the distance "d" between the crusher member 102 and the anvil 101 to increase or decrease between the ends of the cammed surface 112 which ends are reached by the follower 114.

Figure 2:
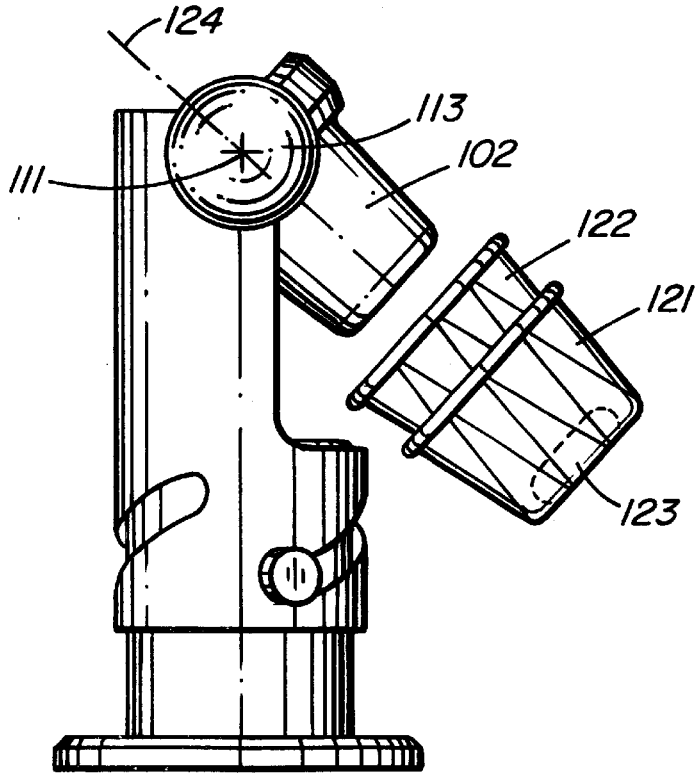
FIG. 2 is a side diagrammatic view similar to FIG. 1 but illustrating the anvil rotating about a rotational axis to allow placement of the medication on the crusher member.

A pair of small paper cups 121, 122 are illustrated in FIG. 2 where the crusher member 102 is illustrated as having been rotated by handles 113 and shaft 104 about axis 111. The medication 123 to be crushed is placed inside cup 121 and, to prevent contamination and spillage, a second cup 122 is placed over the medication 123 and fits inside the first cup 121. The cups 121, 122 are intended to be placed over the crusher member 102 as will be explained in greater detail.

Operation

In operation and with reference to FIG. 2, the crusher member 102 will have been rotated about axis 111 by handles 113 until it reaches the first medication access position illustrated. The medication shown in phantom at 123 is placed inside the first paper cup 121. A second paper cup 122 is placed inside the first paper cup 121 and covers the medication. The user then places the nestled cups 121, 122, over the crusher member 102 which is of a shape complementary to the inside configuration of the paper cups 121, 122, conveniently frustoconical, and rotates the crusher member 102 in a reverse rotational direction about axis 111 using handles 113 until the axis 124 of the crusher member 102 is coincident with axis 120 (FIG. 1).

Figure 3:
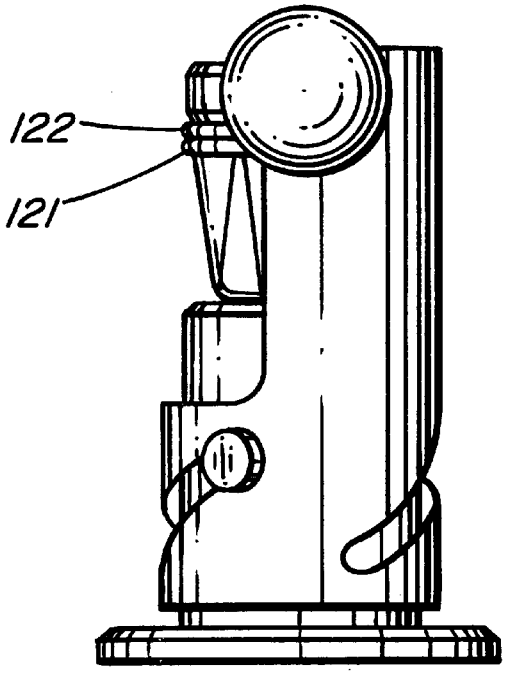
FIG. 3 is a side diagrammatic view similar to FIGS. 1 and 2 but particularly illustrating the crushing action of the medication caused by rotational movement between the crusher member and the anvil.

The housing 110 is then rotated about axis 120 with the use again of handles 113. The action of the cammed surface 112 and follower 114 will decrease the distance between the crusher member 102 and the anvil 101 until there is good compressive force between the two members 101, 102 and, of course, on the medication 123 within cup 121 (FIG. 3). The medication will be easily crushed due to the rotational action and paper cup 122 will move inwardly relative to cup 121.

Figure 4:
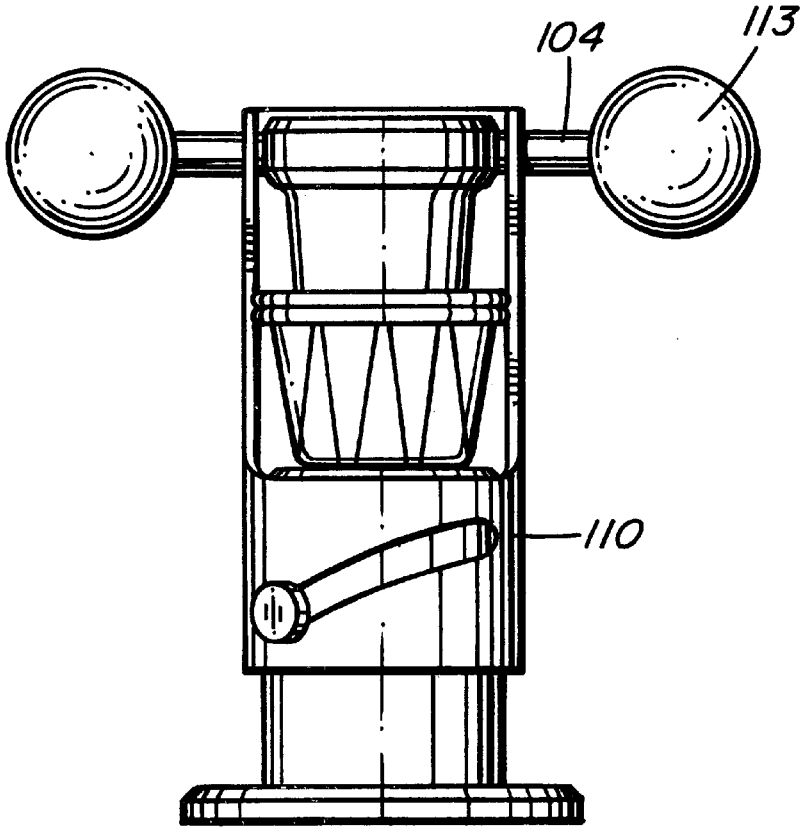
FIG. 4 is a side diagrammatic view of the medication crusher illustrating the rotational movement allowing an increase in distance between the crusher member and anvil thereby to allow release of the crushed medication.

Following the crushing action, handles 113 will be used to rotate the housing 110 in an opposite direction from that used to crush the medication 123 as seen in FIG. 4. Thereafter, the shaft 104 is rotated with handles 113 within housing 110 until the crusher member 102 reaches the same position illustrated in FIG. 2. The paper cups 121, 122, containing the medication 123 are removed from the crusher member 102 and presented to the user of the medication or otherwise processed and added to the food of the patient for example.

Many modifications will readily occur to those skilled in the art to which the invention relates. While a pair of paper cups 121, 122 are conveniently used with the medication in order to prevent contamination with the crusher member 102 and to prevent spillage during operation and subsequent movement of the paper cups, it is apparent that a single receptacle for the medication could also be used. Similarly, while the base 105 is stationary in the example given and the housing 110 is rotatable relative to the base 105, it is apparent that, under certain conditions, it may be desirable to give the base 105 movement relative to the housing 110. While movement of the housing 110 relative to the base 105 is also disclosed as being brought about by the cammed surface 112 and follower 114, it is also apparent that many other techniques could be used to allow the necessary rotational movement between the base 105 and the housing 110 to bring the anvil 101 and crusher member 102 into close or contacting relationship thereby to allow the crushing of the medication.

Many further modifications will readily occur to those skilled in the art to which the invention relates and the specific embodiments described should be taken as illustrative of the invention only and not as limiting its scope as defined in accordance with the accompanying claims.

I claim:

1. Apparatus for crushing medication comprising an anvil, a crusher member separated from said anvil, said crusher member and said anvil having relative rotational movement about a first rotational axis extending perpendicular to said anvil to allow said anvil and said crusher member to decrease the distance therebetween so as to crush said medication and to allow the distance between said anvil and said crusher member to increase thereby to reduce and terminate force between said crusher member and said anvil, one of said crusher member and said anvil being rotatable about a second rotational axis perpendicular to said first rotational axis to allow release of said medication from one of said anvil or crusher member.

2. Apparatus according to claim 1 wherein said anvil is operably connected to a base, said distance between said crusher member and said anvil increasing or decreasing by movement of said crusher member relative to said base.

3. Apparatus according to claim 2 wherein said crusher member is connected to a housing, said housing being rotatable relative to said base.

4. Apparatus according to claim 3 wherein said crusher member is rotatable about a second axis and mounted within said housing, said second axis being perpendicular to said first axis.

5. Apparatus according to claim 4 wherein said housing rotates relative to said base using a cam surface and a follower.

6. Apparatus according to claim 5 wherein said crusher member has a frustoconical configuration.

7. Apparatus according to claim 6 wherein said crusher member is mounted on a shaft, said shaft being rotatable relative to said housing about said first axis.

8. Apparatus according to claim 7 wherein said shaft has handles.

9. Method of crushing medication comprising the steps of positioning said medication between an anvil and a crusher member, rotating one of said anvil or crusher member in a first direction to cause relative rotational movement about a first axis between said anvil and said crusher member and to decrease the distance between said anvil and said crusher member and crush said medication, rotating one of said anvil or base in a direction opposite to said first direction to increase the distance between said anvil and said crusher member and rotating one of said anvil or crusher member about a second axis perpendicular to said first axis to allow access and removal of said crushed medication.

10. Method as in claim 9 wherein said crusher member is rotated about said first axis relative to said anvil.

11. Method as in claim 10 wherein said crusher member is rotated about said second axis to allow access and removal of said medication.

12. Method as in claim 11 wherein said medication is placed in a first receptacle prior to positioning said medication between said anvil and said crusher member.

13. Method as in claim 12 wherein said medication in said first receptacle is covered by a second receptacle having a configuration similar to said first receptacle.

14. Method as in claim 13 wherein said first and second receptacles cover said medication in a nesting relationship and said medication is crushed between said first and second receptacles.

15. Method as in claim 14 wherein said crushing member has a configuration similar to said configuration of said first and second receptacles, said first and second receptacles being positioned on said crushing member when said crushing member is rotated about said second axis.

16. Method as in claim 15 wherein said configuration of said first and second receptacles and said crushing member is frustoconical.

17. Method as in claim 16 wherein said first axis and said second axis are perpendicular.

18. Method as in claim 16 wherein said first and second receptacles are paper cups.

* * * * *